US011371760B2

(12) United States Patent
Nishiyama

(10) Patent No.: US 11,371,760 B2
(45) Date of Patent: Jun. 28, 2022

(54) REFRIGERATION CYCLE APPARATUS

(71) Applicant: Mitsubishi Electric Corporation, Tokyo (JP)

(72) Inventor: Takumi Nishiyama, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 17/057,030

(22) PCT Filed: Jul. 27, 2018

(86) PCT No.: PCT/JP2018/028221
§ 371 (c)(1),
(2) Date: Nov. 19, 2020

(87) PCT Pub. No.: WO2020/021700
PCT Pub. Date: Jan. 30, 2020

(65) Prior Publication Data
US 2021/0108842 A1 Apr. 15, 2021

(51) Int. Cl.
*F25B 1/00* (2006.01)
*F25B 5/02* (2006.01)
(Continued)

(52) U.S. Cl.
CPC ..... *F25B 47/02* (2013.01); *F25B 1/00* (2013.01); *F25B 5/02* (2013.01); *F25B 6/02* (2013.01)

(58) Field of Classification Search
CPC ..... F25B 47/02; F25B 47/022; F25B 47/025; F25B 13/00; F25B 41/26; F25B 2313/025;
(Continued)

(56) References Cited

U.S. PATENT DOCUMENTS 9,217,587 B2 * 12/2015 Cho ..... F25B 13/00
10,113,776 B2 * 10/2018 Chaudhry ..... F25B 5/04
(Continued)

FOREIGN PATENT DOCUMENTS

JP S56-029759 U 3/1981
JP 59-219669 A 12/1984
(Continued)

OTHER PUBLICATIONS

Office Action dated Oct. 27, 2021, issued in corresponding CN Patent Application No. 201880095569.7 (and English Machine Translation).
(Continued)

*Primary Examiner* — Miguel A Diaz
(74) *Attorney, Agent, or Firm* — Posz Law Group, PLC

(57) ABSTRACT

In a refrigeration cycle apparatus according to the present invention, a non-azeotropic refrigerant mixture is used. The refrigeration cycle apparatus includes a compressor, a first heat exchanger, a decompressor, a second heat exchanger, a third heat exchanger, and a blower. The blower blows air to the second heat exchanger and the third heat exchanger. The non-azeotropic refrigerant mixture circulates in a first circulation direction through the compressor, the first heat exchanger, the decompressor, the second heat exchanger, and the third heat exchanger. The second heat exchanger is greater in flow path resistance than the third heat exchanger. The blower forms a parallel flow with the non-azeotropic refrigerant mixture that flows through the second heat exchanger and the third heat exchanger.

8 Claims, 12 Drawing Sheets

(51) Int. Cl.
*F25B 6/02* (2006.01)
*F25B 47/02* (2006.01)

(58) Field of Classification Search
CPC ..... F25B 2313/0253–02533; F25B 2313/0254–02543; F25B 1/00; F25B 5/00; F25B 5/02; F25B 5/04; F25B 6/00; F25B 6/02; F25B 6/04
See application file for complete search history.

(56) References Cited

U.S. PATENT DOCUMENTS

| | | | | |
|---|---|---|---|---|
| 10,161,652 | B2 * | 12/2018 | Morishita | F25B 13/00 |
| 10,386,081 | B2 * | 8/2019 | Yokozeki | F25B 1/00 |
| 10,883,745 | B2 * | 1/2021 | Higashiiue | F25B 5/04 |
| 10,928,105 | B2 * | 2/2021 | Ito | F25B 13/00 |
| 11,047,590 | B2 * | 6/2021 | Yamada | F24F 11/84 |
| 11,175,080 | B2 * | 11/2021 | Nishiyama | F25B 41/26 |
| 2012/0260678 | A1 * | 10/2012 | Yoshida | F25B 41/31 62/56 |
| 2013/0091882 | A1 * | 4/2013 | Cho | F25B 13/00 62/156 |
| 2014/0109613 | A1 * | 4/2014 | Ohno | F25B 13/00 62/498 |
| 2015/0107286 | A1 * | 4/2015 | Jin | F25B 30/02 62/222 |
| 2015/0211772 | A1 * | 7/2015 | Shimazu | F25B 40/02 62/196.4 |
| 2015/0276280 | A1 * | 10/2015 | Furui | F25B 13/00 62/160 |
| 2015/0316275 | A1 * | 11/2015 | Yamashita | F25B 49/02 62/228.1 |
| 2015/0338121 | A1 * | 11/2015 | Yamashita | F24F 5/001 62/196.1 |
| 2017/0002245 | A1 * | 1/2017 | Fukushima | C09K 5/045 |
| 2017/0108249 | A1 | 4/2017 | Morishita | |
| 2017/0268790 | A1 | 9/2017 | Yokozeki et al. | |
| 2018/0023850 | A1 * | 1/2018 | Chaudhry | F24F 13/20 62/262 |
| 2018/0283752 | A1 * | 10/2018 | Yoon | F25B 49/02 |
| 2018/0372379 | A1 * | 12/2018 | Kamitani | F25B 49/02 |
| 2019/0137146 | A1 | 5/2019 | Higashiiue et al. | |
| 2019/0234643 | A1 * | 8/2019 | Yamada | F24F 11/84 |
| 2019/0257554 | A1 * | 8/2019 | Ito | F25B 13/00 |
| 2019/0277549 | A1 * | 9/2019 | Nishiyama | F25B 47/006 |
| 2020/0173696 | A1 * | 6/2020 | Yan | F25B 41/20 |
| 2020/0232693 | A1 * | 7/2020 | Watanabe | F25B 41/20 |
| 2021/0108840 | A1 * | 4/2021 | Saho | F25B 41/20 |

FOREIGN PATENT DOCUMENTS

| | | | | |
|---|---|---|---|---|
| JP | 07190571 | A | * 7/1995 | |
| JP | H07-190571 | A | 7/1995 | |
| JP | 10-068560 | A | 3/1998 | |
| JP | 10068560 | A | * 3/1998 | |
| JP | 11-304292 | A | 11/1999 | |
| JP | 2007-155192 | A | 6/2007 | |
| JP | 2007155192 | A | * 6/2007 | F25B 9/006 |
| JP | 2009-257740 | A | 11/2009 | |
| JP | 2012-052676 | A | 3/2012 | |
| JP | 2012-145302 | A | 8/2012 | |
| JP | 2016-114263 | A | 6/2016 | |
| WO | 2015/151289 | A1 | 10/2015 | |
| WO | 2018/002983 | A1 | 1/2018 | |

OTHER PUBLICATIONS

Office Action dated Nov. 16, 2021, issued in corresponding JP Patent Application No. 2020-532107 (and English Machine Translation).
International Search Report of the International Searching Authority dated Oct. 16, 2018 for the corresponding International application No. PCT/JP2018/028221 (and English translation).
Extended European Search Report dated Jul. 1, 2021 issued in corresponding EP application No. 18927363.4.
Office Action dated Mar. 8, 2022, issued in corresponding JP Patent Application No. 2020-532107 (and English Machine Translation).

* cited by examiner

REFRIGERATION CYCLE APPARATUS

CROSS REFERENCE TO RELATED APPLICATION

This application is a U.S. national stage application of PCT/JP2018/028221 filed on Jul. 27, 2018, the contents of which are incorporated herein by reference.

TECHNICAL FIELD

The present invention relates to a refrigeration cycle apparatus in which a non-azeotropic refrigerant mixture is used.

BACKGROUND ART

From a viewpoint of global warming prevention, recently, in a refrigeration cycle apparatus, a non-azeotropic refrigerant mixture is sometimes used that is reduced in global warming potential (GWP) by mixing refrigerant made of a single component with another refrigerant having a lower GWP. For example, WO2015/151289 (PTL 1) discloses an air conditioning apparatus in which a non-azeotropic refrigerant mixture such as R-407C can be used. In the air conditioning apparatus, a heat source-side heat exchanger includes a first heat exchange unit and a second heat exchange unit. When the outlet temperature of the first heat exchange unit is higher than the outlet temperature of the second heat exchange unit, the flow rate of the heat medium circulating through the first heat exchange unit is reduced, thereby allowing a defrosting ability to be uniformly achieved in the entire region of the heat source-side heat exchanger.

CITATION LIST

Patent Literature

PTL 1: WO2015/151289

SUMMARY OF INVENTION

Technical Problem

It is known that a non-azeotropic refrigerant mixture has a characteristic (a temperature gradient) that, at constant pressure, the non-azeotropic refrigerant mixture existing as saturated vapor is higher in temperature than the non-azeotropic refrigerant mixture existing as a saturated liquid. Thus, in the state where the pressure in the evaporation process of the non-azeotropic refrigerant mixture is constant in the refrigeration cycle apparatus, due to a temperature gradient, the non-azeotropic refrigerant mixture flowing into a heat exchanger functioning as an evaporator is lower in temperature than the non-azeotropic refrigerant mixture flowing out of this heat exchanger. In this case, frost is more likely to be formed near a port of the heat exchanger into which the non-azeotropic refrigerant mixture flows. However, for the air conditioning apparatus disclosed in PTL 1, no consideration is given to the temperature decrease near the port of the heat exchanger into which the non-azeotropic refrigerant mixture flows.

The present invention has been made in order to solve the above-described problems. An object of the present invention is to suppress performance deterioration caused by formation of frost on a heat exchanger in a refrigeration cycle apparatus in which a non-azeotropic refrigerant mixture is used.

Solution to Problem

In a refrigeration cycle apparatus according to the present invention, a non-azeotropic refrigerant mixture is used. The refrigeration cycle apparatus includes a compressor, a first heat exchanger, a decompressor, a second heat exchanger, a third heat exchanger, and a blower. The blower is configured to blow air to the second heat exchanger and the third heat exchanger. The non-azeotropic refrigerant mixture circulates in a first circulation direction through the compressor, the first heat exchanger, the decompressor, the second heat exchanger, and the third heat exchanger. The second heat exchanger is greater in flow path resistance than the third heat exchanger. The blower is configured to form a parallel flow with the non-azeotropic refrigerant mixture flowing through the second heat exchanger and the third heat exchanger.

Advantageous Effects of Invention

According to the refrigeration cycle apparatus of the present invention, the second heat exchanger is greater in flow path resistance than the third heat exchanger, and the blower forms a parallel flow with the non-azeotropic refrigerant mixture flowing through the second heat exchanger and the third heat exchanger, thereby allowing suppression of formation of frost on the second heat exchanger and the third heat exchanger. As a result, the performance deterioration caused by formation of frost on a heat exchanger can be suppressed.

DESCRIPTION OF EMBODIMENTS

Figure 1:
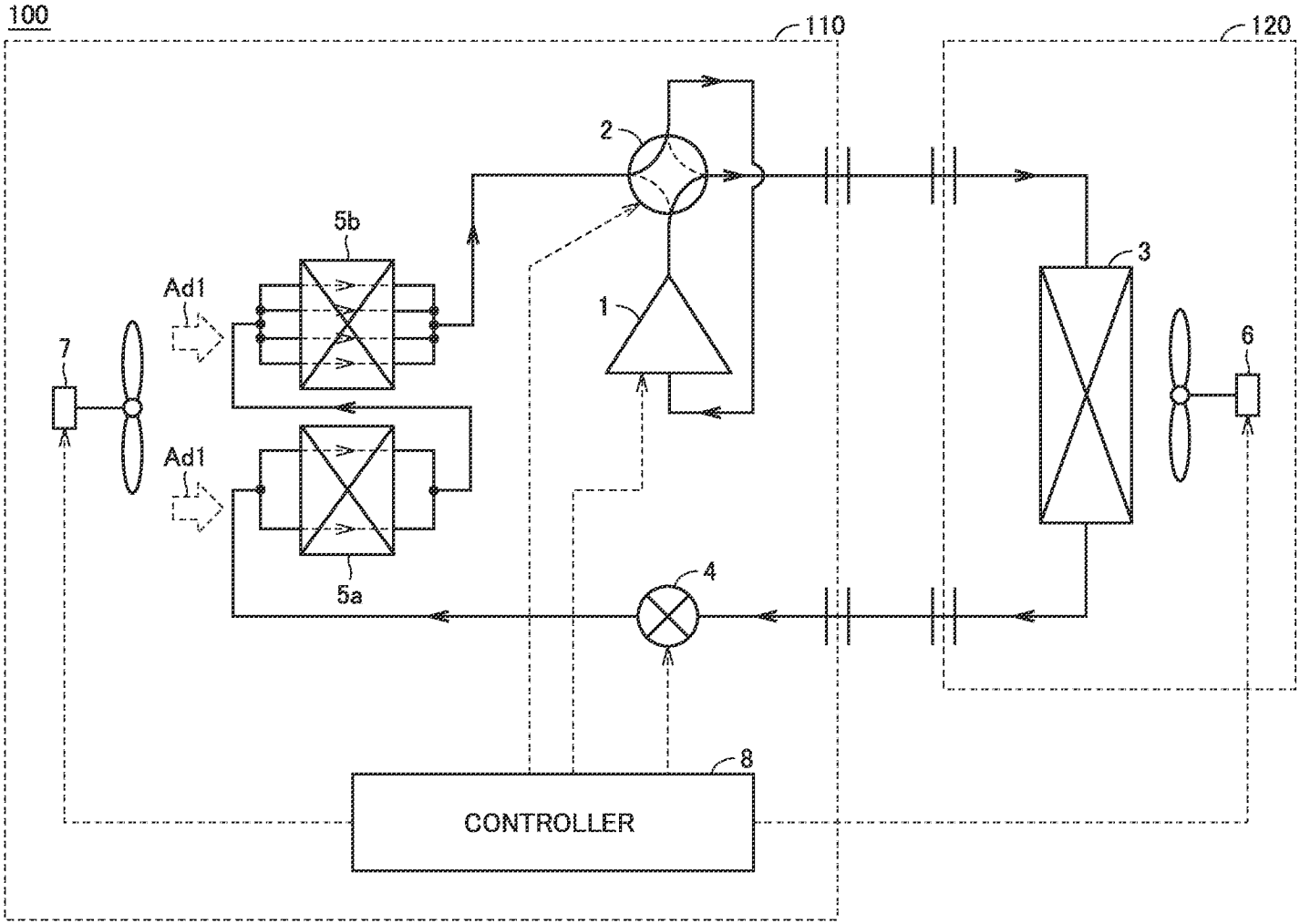
FIG. 1 is a functional block diagram showing a configuration of a refrigeration cycle apparatus according to the first embodiment together with the flow of a non-azeotropic refrigerant mixture in a heating operation.

Embodiments of the present invention will be hereinafter described in detail with reference to the accompanying drawings, in which the same or corresponding components will be denoted by the same reference characters, and the description thereof will not be basically repeated.

First Embodiment

FIG. 1 is a functional block diagram showing a configuration of a refrigeration cycle apparatus 100 according to the first embodiment together with the flow of a non-azeotropic refrigerant mixture in a heating operation. Refrigeration cycle apparatus 100 may be a package air conditioner (PAC) or a room air conditioner (RAC), for example.

As shown in FIG. 1, refrigeration cycle apparatus 100 includes an outdoor unit 110 and an indoor unit 120. Outdoor unit 110 includes a compressor 1, a four-way valve 2 (a flow path switching valve), an expansion valve 4 (a decompressor), a heat exchanger 5*a* (a second heat exchanger), a heat exchanger 5*b* (a third heat exchanger), an outdoor fan 7 (a blower), and a controller 8. Indoor unit 120 includes a heat exchanger 3 (a first heat exchanger) and an indoor fan 6.

In refrigeration cycle apparatus 100, a non-azeotropic refrigerant mixture is used that is reduced in GWP as compared with the conventionally used refrigerant (for example, R404A or R410A). Specifically, the non-azeotropic refrigerant mixture includes R32 and has a temperature gradient of 3 degrees or more at standard atmospheric pressure.

The weight ratio of HFC32 is desirably set at 46 wt % or less. The weight ratio of HFC32 set at 46 wt % or less allows the GWP of the non-azeotropic refrigerant mixture to be reduced to about 300. As a result, even in the case where the amount of used non-azeotropic refrigerant mixture increases as the number of shipments of refrigeration cycle apparatus 100 increases, the regulations for refrigerant (for example, the Montreal Protocol or the F-gas regulations) can be satisfied.

HFC32 raises the operating pressure of the non-azeotropic refrigerant mixture. HFC32 is contained in the non-azeotropic refrigerant mixture to thereby allow reduction of the volume (stroke volume) of compressor 1 that is required for ensuring desired operating pressure, with the result that compressor 1 can be reduced in size.

It is desirable that the refrigerant contained in the non-azeotropic refrigerant mixture in addition to HFC32 is refrigerant (for example, R1234yf, R1234ze(E), R290, or CO2) that is lower in GWP than the conventionally used refrigerant. In a range in which reduction of the GWP is not prevented, the non-azeotropic refrigerant mixture may contain refrigerant (for example, R134a or R125) that is higher in GWP than the conventionally used refrigerant. The non-azeotropic refrigerant mixture may also contain three or more types of refrigerant.

Controller 8 controls the driving frequency of compressor 1 to thereby control the amount of refrigerant discharged from compressor 1 per unit time such that the temperature inside indoor unit 120 measured by a temperature sensor (not shown) reaches a desired temperature (for example, the temperature set by a user). Controller 8 controls the degree of opening of expansion valve 4 such that the degree of superheating or the degree of supercooling of the non-azeotropic refrigerant mixture attains a value in a desired range. Controller 8 controls the amount of air blown from each of indoor fan 6 and outdoor fan 7 per unit time such that the temperature in indoor unit 120 reaches a desired temperature. Controller 8 controls the amount of air blown from indoor fan 6 per unit time while prioritizing the user's setting (for example, a weak wind mode or a strong wind mode) for indoor fan 6. Controller 8 controls four-way valve 2 to switch the direction in which the non-azeotropic refrigerant mixture circulates. In addition, in accordance with the temperature difference between the discharge temperature of compressor 1 and the heat-resistance temperature (for example, 100° C.) of compressor 1 that has been set in advance, controller 8 may adjust the driving frequency of compressor 1, the amount of air blown from each of indoor fan 6 and outdoor fan 7 per unit time, and the degree of opening of expansion valve 4.

Controller 8 controls four-way valve 2 to allow, in the heating operation, communication between the discharge port of compressor 1 and heat exchanger 3, and communication between heat exchanger 5*b* and the suction port of compressor 1. In the heating operation, the non-azeotropic refrigerant mixture circulates in a circulation direction (the first circulation direction) through compressor 1, four-way valve 2, heat exchanger 3, expansion valve 4, heat exchanger 5*a*, heat exchanger 5*b*, and four-way valve 2.

Heat exchangers 5*a* and 5*b* are connected in series between expansion valve 4 and four-way valve 2. Heat exchanger 5*a* is greater in flow path resistance than heat exchanger 5*b*. In other words, the pressure loss in heat exchanger 5*a* is greater than the pressure loss in heat exchanger 5*b*. Specifically, heat exchanger 5*a* includes at least one heat transfer tube formed so as to extend in parallel, and heat exchanger 5*b* includes a plurality of heat transfer tubes formed so as to extend in parallel. The number of heat transfer tubes in heat exchanger 5*a* is less than the number of heat transfer tubes in heat exchanger 5*b*. In FIG. 1, heat exchanger 5*a* includes two heat transfer tubes and heat exchanger 5*b* includes four heat transfer tubes, but the number of heat transfer tubes included in each of heat exchangers 5*a* and 5*b* is not limited to the number shown in FIG. 1.

The non-azeotropic refrigerant mixture exchanges heat with air while it flows through the heat transfer tubes included in heat exchangers 5*a* and 5*b*. Outdoor fan 7 blows air to heat exchangers 5*a* and 5*b* to form a parallel flow with the non-azeotropic refrigerant mixture that flows through heat exchangers 5*a* and 5*b*. Heat exchangers 5*a* and 5*b* are disposed to extend in the direction orthogonal to an air blowing direction Ad1 of the blower. In FIG. 1, a connection pipe is formed such that the non-azeotropic refrigerant mixture flowing out of heat exchanger 5*a* and the non-azeotropic refrigerant mixture flowing out of heat exchanger 5*b* join each other and flow toward heat exchanger 5*b*, but the manner of the connection pipe that connects heat exchangers 5*a* and 5*b* is not limited to the manner of connection shown in FIG. 1. For example, the connection pipe may be formed such that the non-azeotropic refrigerant mixtures flowing out of heat exchangers 5*a* and 5*b* flow toward heat exchanger 5*b* without joining each other.

In the diagram shown in FIG. 1, each of the heat transfer tubes included in heat exchangers 5*a* and 5*b* is formed to extend in a straight line from one port to the other port, but may be formed to meander from one port to the other port. Heat exchanger 5*a* may be different in structure (for example, the pitch in the column direction, the pitch in the row direction, or the pitch of fins) from heat exchanger 5*b*. In order to distribute the non-azeotropic refrigerant mixture evenly to the heat transfer tubes in heat exchangers 5*a* and 5*b*, a distribution device or a distributor may be provided between heat exchangers 5*a* and 5*b*.

Figure 2:
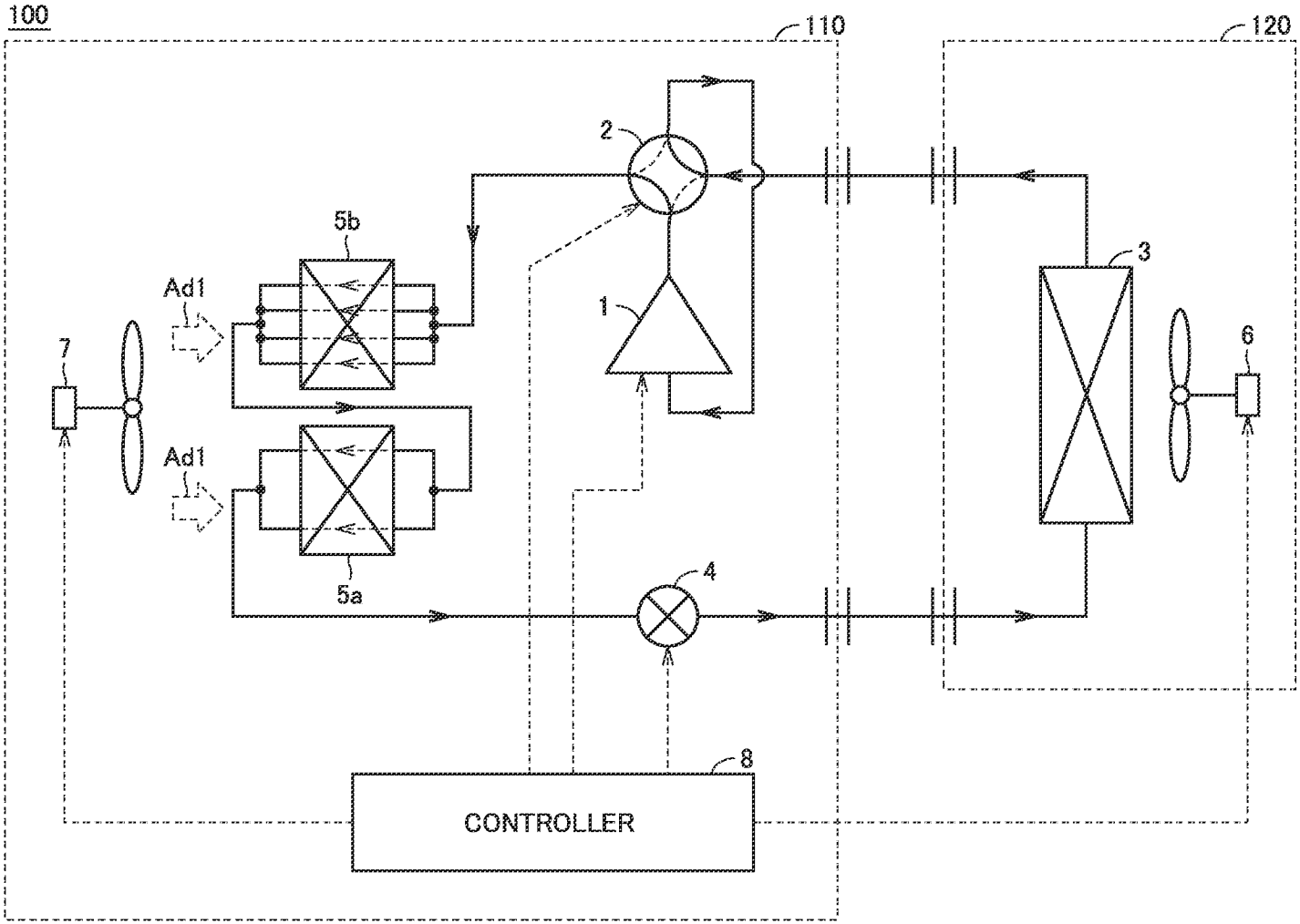
FIG. 2 is a functional block diagram showing the configuration of the refrigeration cycle apparatus in FIG. 1 together with the flow of the non-azeotropic refrigerant mixture in a cooling operation and a defrosting operation.

FIG. 2 is a functional block diagram showing the configuration of refrigeration cycle apparatus 100 in FIG. 1 together with the flow of the non-azeotropic refrigerant mixture in a cooling operation and a defrosting operation. As shown in FIG. 2, controller 8 controls four-way valve 2 to allow, in the cooling operation and the defrosting operation, communication between the discharge port of compressor 1 and heat exchanger 5*b*, and communication between heat exchanger 3 and the suction port of compressor 1. In the cooling operation and the defrosting operation, the non-azeotropic refrigerant mixture circulates in a circulation direction (in the second circulation direction) through compressor 1, four-way valve 2, heat exchanger 5*b*, heat exchanger 5*a*, expansion valve 4, heat exchanger 3, and four-way valve 2.

In the heating operation, when the temperature near the port of heat exchanger 5*a* through which the non-azeotropic refrigerant mixture flows in is equal to or less than a threshold value (for example, −2° C.) or when a reference time has passed since this temperature became equal to or less than the threshold value, controller 8 controls four-way valve 2 to switch the circulation direction of the non-azeotropic refrigerant mixture so as to start the defrosting operation. After the defrosting completion time has passed since the start of the defrosting operation, controller 8 ends the defrosting operation and resumes the heating operation.

In the defrosting operation, controller 8 stops the indoor fan to prevent the air cooled by heat exchanger 3 functioning as an evaporator from being blown into a room. Controller 8 stops outdoor fan 7 or reduces the amount of air blown from outdoor fan 7 per unit time to thereby suppress heat exchange between air and the non-azeotropic refrigerant mixture that flows through heat exchangers 5*a* and 5*b* so as to facilitate melting of frost by sensible heat and latent heat of the non-azeotropic refrigerant mixture.

Also in the cooling operation and the defrosting operation, outdoor fan 7 blows air in air blowing direction Ad1 as in the heating operation. On the other hand, the direction in which the non-azeotropic refrigerant mixture flows through heat exchangers 5*a* and 5*b* is opposite to that in the heating operation. Thus, a counterflow is formed by the non-azeotropic refrigerant mixture flowing through heat exchangers 5*a* and 5*b*, and the air blown from outdoor fan 7.

Heat exchangers 5*a* and 5*b* each function as an evaporator in the heating operation, and function as a condenser in the cooling operation and the defrosting operation. The state of the non-azeotropic refrigerant mixture changes in the condensation process in a condenser in the order of: gas having a degree of superheating; a gas-liquid two-phase state; and a liquid having a degree of supercooling. On the other hand, in the evaporation process in an evaporator, the state of the non-azeotropic refrigerant mixture is almost in a gas-liquid two-phase state. The temperature of the non-azeotropic refrigerant mixture changes more greatly in the condensation process than in the evaporation process.

Thus, in refrigeration cycle apparatus 100, air blowing direction Ad1 of outdoor fan 7 is defined such that air blowing direction Ad1 of outdoor fan 7 and the direction of the non-azeotropic refrigerant mixture flowing through heat exchangers 5*a*, 5*b* form a parallel flow in the heating operation and form a counterflow in the cooling operation. By defining air blowing direction Ad1 in this way, the heat exchange efficiency of heat exchangers 5*a* and 5*b* in the cooling operation can be improved while suppressing deterioration in heat exchange efficiency of heat exchangers 5*a* and 5*b* in the heating operation.

Figure 3:
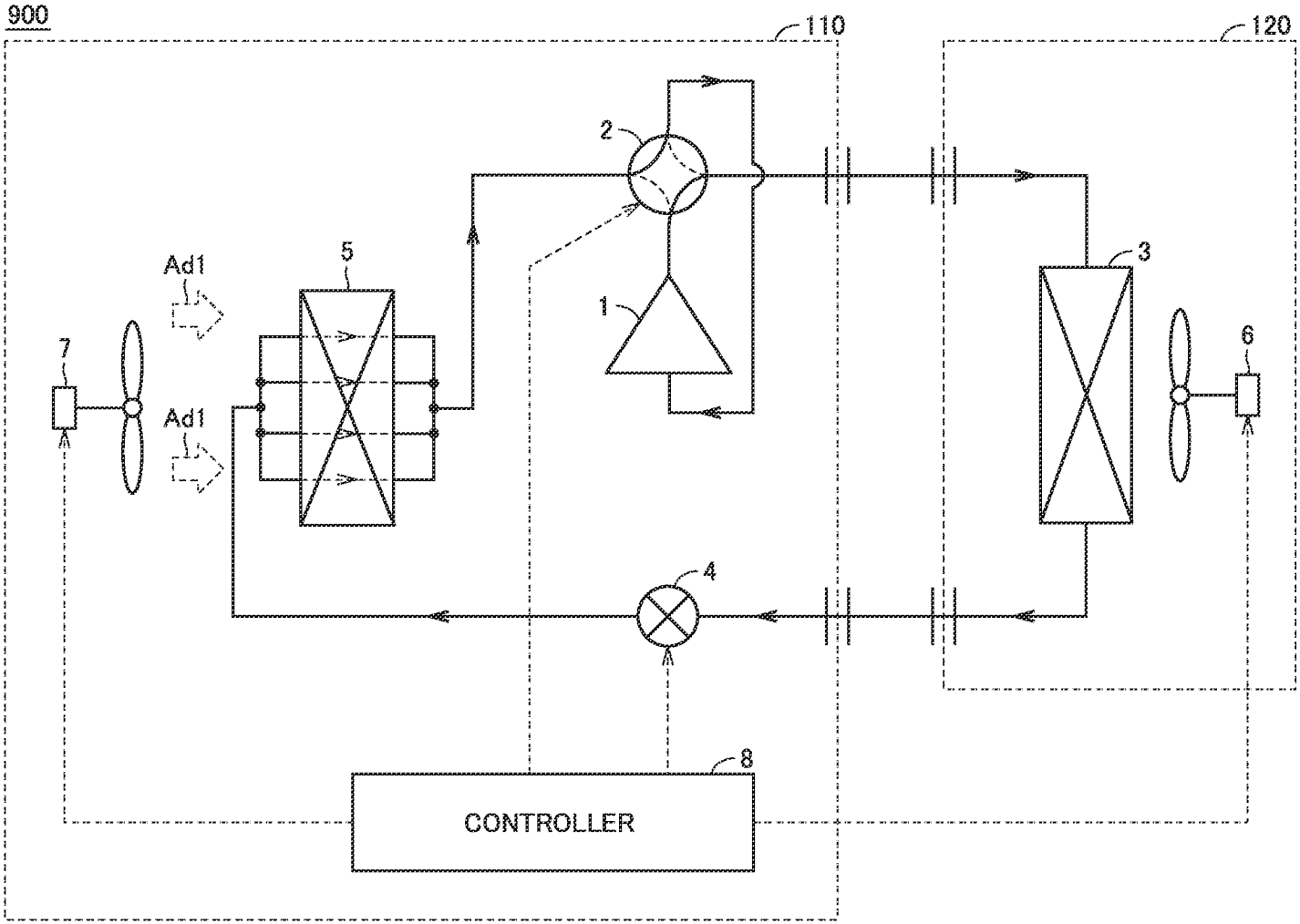
FIG. 3 is a diagram showing a configuration of a refrigeration cycle apparatus according to a comparative example together with the flow of the non-azeotropic refrigerant mixture in the heating operation.

FIG. 3 is a diagram showing a configuration of a refrigeration cycle apparatus 900 according to a comparative example together with the flow of the non-azeotropic refrigerant mixture in the heating operation. Refrigeration cycle apparatus 900 has the same configuration as that of refrigeration cycle apparatus 100 in FIG. 1 except that heat exchangers 5*a* and 5*b* in refrigeration cycle apparatus 100 are replaced with a heat exchanger 5. Since the configuration other than the above is the same, the description thereof will not be repeated.

Figure 4:
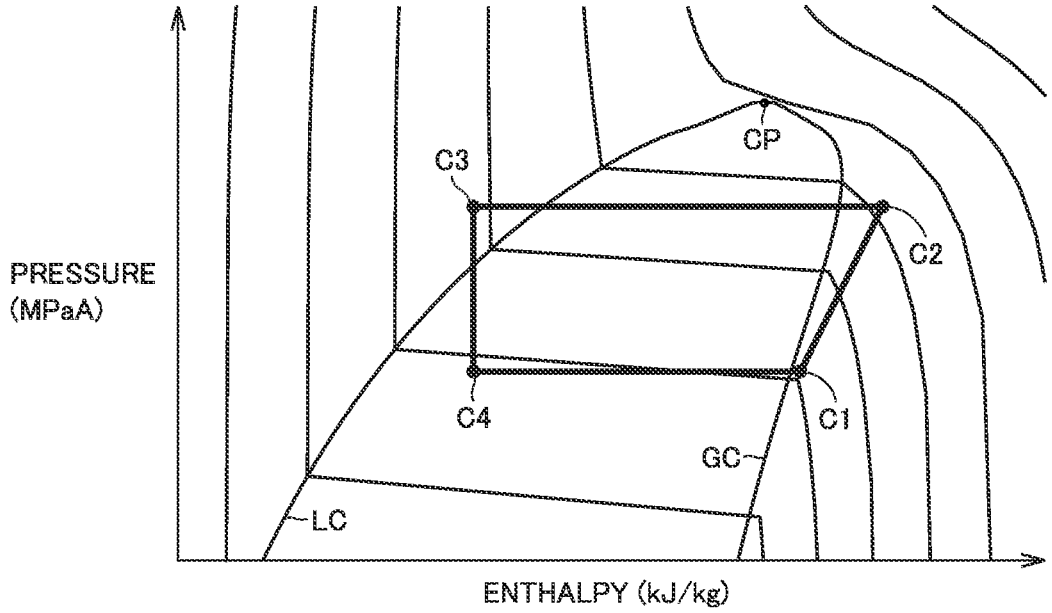
FIG. 4 is a P-h diagram showing the relation among enthalpy, pressure, and a temperature of the non-azeotropic refrigerant mixture in the refrigeration cycle apparatus in FIG. 3.

FIG. 4 is a P-h diagram showing the relation among enthalpy, pressure, and a temperature of the non-azeotropic refrigerant mixture in refrigeration cycle apparatus 900 in FIG. 3. In FIG. 4, curved lines LC and GC show a saturated liquid line and a saturated vapor line, respectively. The saturated liquid line and the saturated vapor line are connected to each other at a critical point CP. The same applies to FIG. 6, which will be described later.

Referring to FIG. 4, the process from a state C1 to a state C2 shows the adiabatic compression process by compressor 1. The process from state C2 to a state C3 shows the condensation process by heat exchanger 3. The process from state C3 to a state C4 shows the decompression process by expansion valve 4. The process from state C4 to state C1 shows the evaporation process by heat exchanger 5.

Figure 5:
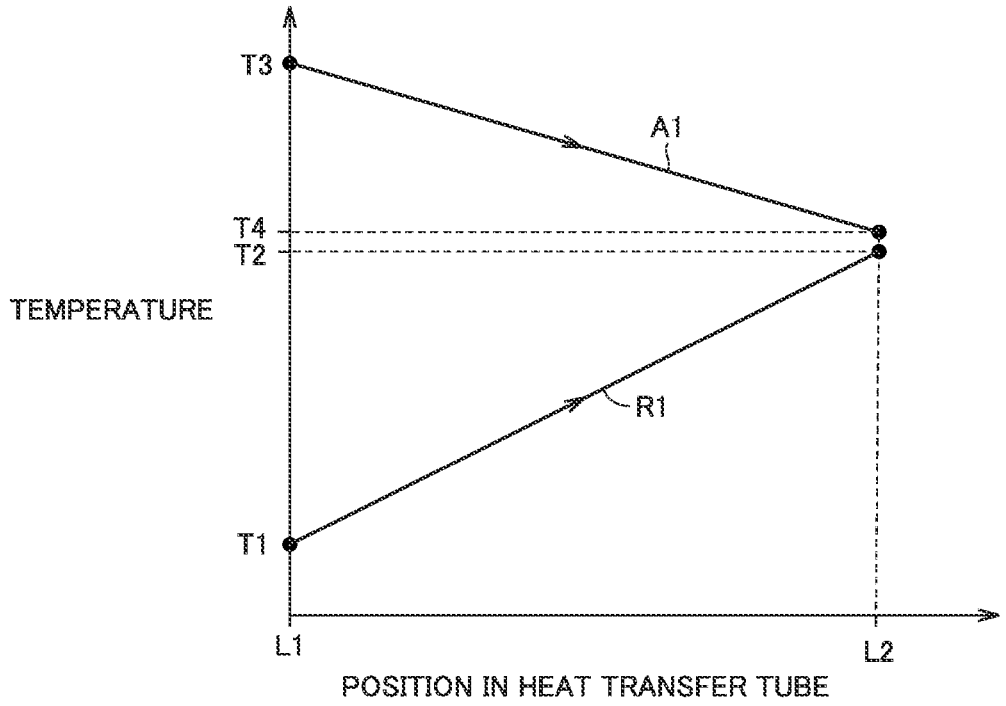
FIG. 5 is a diagram showing: the correspondence relation between the position in a certain heat transfer tube of a heat exchanger in FIG. 3 and the temperature of the non-azeotropic refrigerant mixture at this position; and the correspondence relation between this position and the temperature of air at this position.

FIG. 5 is a diagram showing: a correspondence relation R1 between the position in a certain heat transfer tube of heat exchanger 5 in FIG. 3 and the temperature of the non-azeotropic refrigerant mixture at this position; and a correspondence relation A1 between this position and the temperature of air at this position. In FIG. 5, a position L1 shows the position of the port of heat exchanger 5 through which a non-azeotropic refrigerant mixture flows in. A position L92 shows the position of the port of heat exchanger 5 through which a non-azeotropic refrigerant mixture flows out. A temperature T1 shows the temperature in state C4 in FIG. 4. A temperature T2 shows the temperature in state C1 in FIG. 4.

As shown in FIG. 5, the non-azeotropic refrigerant mixture flowing from position L1 into heat exchanger 5 absorbs heat from air in the process in which the non-azeotropic refrigerant mixture flows from position L1 to position L2. As a result, the temperature of the non-azeotropic refrigerant mixture rises from T1 to T2. On the other hand, the air blown by outdoor fan 7 to heat exchanger 5 is deprived of heat due to absorption by the non-azeotropic refrigerant mixture flowing through heat exchanger 5 in the process in which the air flows from position L1 to position L2. As a result, the temperature of the air lowers from T3 to T4.

In the case where the degree of superheating of the non-azeotropic refrigerant mixture suctioned by compressor 1 is maintained in a prescribed range, the temperature of the non-azeotropic refrigerant mixture suctioned by compressor 1 is approximately constant. Accordingly, as the temperature gradient of the non-azeotropic refrigerant mixture becomes larger, temperature T4 of the non-azeotropic refrigerant mixture flowing into heat exchanger 5 becomes lower, and thereby, frost is more likely to be formed on heat exchanger 5. As a result, the performance of refrigeration cycle apparatus 900 may deteriorate.

Thus, in refrigeration cycle apparatus 100, two heat exchangers 5*a* and 5*b* connected in series each are caused to function as an evaporator in the heating operation. The flow path resistance of heat exchanger 5*a* is set to be greater than the flow path resistance of heat exchanger 5*b*. Thereby, in the first half of the evaporation process by heat exchanger 5*a*, the temperature rise in the non-azeotropic refrigerant mixture is suppressed. Also, in the latter half of the evaporation process by heat exchanger 5*b*, the temperature of the non-azeotropic refrigerant mixture is raised to a desired temperature. As a result, the temperature of the non-azeotropic refrigerant mixture suctioned by heat exchanger 5*a* can be set to be higher than T1 while the temperature of the non-azeotropic refrigerant mixture suctioned by compressor 1 can be maintained at T2. According to refrigeration cycle apparatus 100, formation of frost on heat exchangers 5*a* and 5*b* each functioning as an evaporator can be suppressed while maintaining the performance. Furthermore, since the frequency of the defrosting operation can be reduced, the comfortableness for users can be improved.

Figure 6:
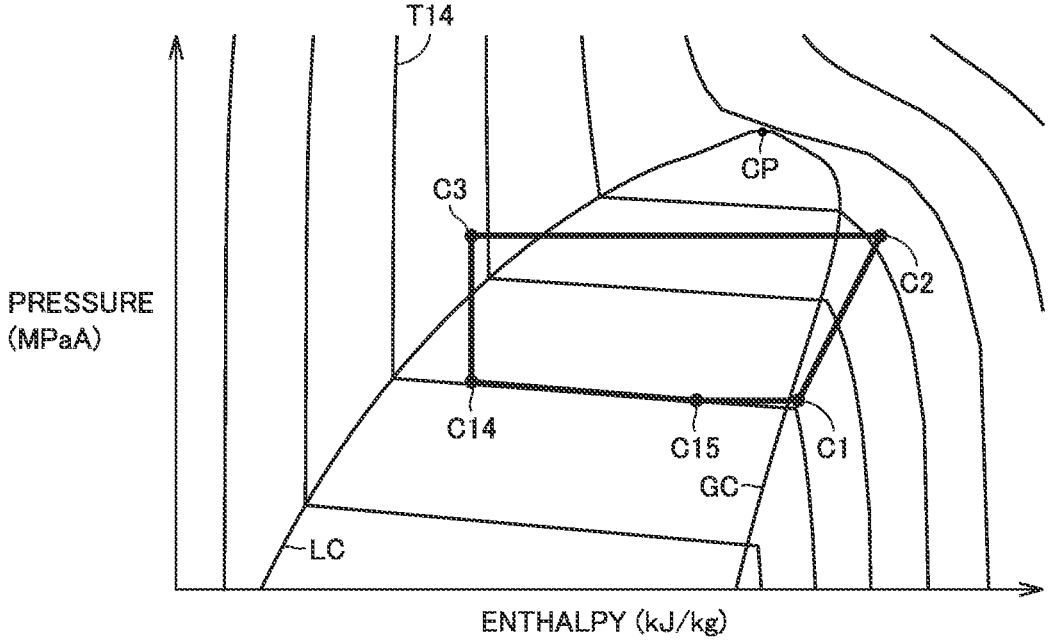
FIG. 6 is a P-h diagram showing the relation among enthalpy, pressure, and a temperature of the non-azeotropic refrigerant mixture in the refrigeration cycle apparatus in FIG. 1.

FIG. 6 is a P-h diagram showing the relation among enthalpy, pressure, and a temperature of the non-azeotropic refrigerant mixture in refrigeration cycle apparatus 100 in FIG. 1. In FIG. 6, states C1 to C3 are the same as those in FIG. 4. The process from a state C14 to a state C15 shows the evaporation process by heat exchanger 5*a*. The process from state C15 to state C1 shows the evaporation process by heat exchanger 5*b*.

As shown in FIG. 6, in the evaporation process from state C14 to state C15, the pressure loss in heat exchanger 5*a* causes the pressure of the non-azeotropic refrigerant mixture to decrease as the evaporation process progresses. The evaporation process from state C14 to state C15 changes along the isothermal line of temperature T14. On the other hand, in the evaporation process from state C15 to state C1, the pressure loss in heat exchanger 5*b* is smaller than the pressure loss in heat exchanger 5*a*. Thus, the pressure decrease in the non-azeotropic refrigerant mixture is less than the pressure decrease in the evaporation process from state C14 to state C15.

Figure 7:
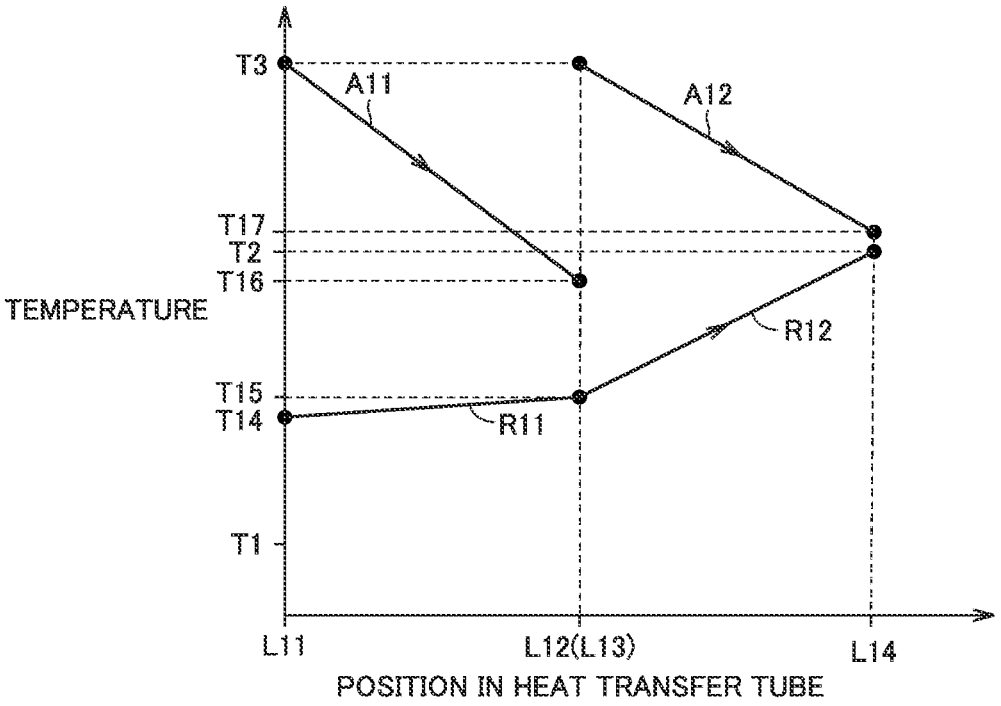
FIG. 7 is a diagram showing: the correspondence relation between the position in a certain heat transfer tube of the heat exchanger in FIG. 1 and the temperature of the non-azeotropic refrigerant mixture at this position; and the correspondence relation between this position and the temperature of air at this position.

FIG. 7 is a diagram showing: correspondence relations R11 and R12 between the position in a certain heat transfer tube of heat exchangers 5*a* and 5*b* in FIG. 1 and the temperature of the non-azeotropic refrigerant mixture at this position; and correspondence relations A11 and A12 between this position and the temperature of air at this position. In FIG. 7, correspondence relation R11 shows the correspondence relation between the position in a certain heat transfer tube of heat exchanger 5*a* and the temperature of the non-azeotropic refrigerant mixture at this position. Correspondence relation A11 shows the correspondence relation between the position in a certain heat transfer tube of heat exchanger 5*a* and the temperature of air at this position. Correspondence relation R12 shows the correspondence relation between the position in a certain heat transfer tube of heat exchanger 5*b* and the temperature of the non-azeotropic refrigerant mixture at this position. Correspondence relation A12 shows the correspondence relation between the position in a certain heat transfer tube of heat exchanger 5*b* and the temperature of air at this position. A position L11 shows the position of the port of heat exchanger 5*a* through which the non-azeotropic refrigerant mixture flows in. A position L12 shows the position of the port of heat exchanger 5*a* through which the non-azeotropic refrigerant mixture flows out. A position L13 shows the position of the port of heat exchanger 5*b* through which the non-azeotropic refrigerant mixture flows in. FIG. 7 shows positions L12 and L13 that are superimposed on each other. A position L14 shows the position of the port of heat exchanger 5*b* through which the non-azeotropic refrigerant mixture flows out. Temperature T14 shows the temperature in state C14 in FIG. 6. Temperature T15 shows the temperature in state C15 in FIG. 6. Temperatures T1 to T3 are the same as those in FIG. 5.

As shown in FIG. 7, the non-azeotropic refrigerant mixture flowing from position L11 into heat exchanger 5*a* absorbs heat from air in the process in which this non-azeotropic refrigerant mixture flows from position L11 to position L12. As a result, the temperature of the non-azeotropic refrigerant mixture rises from T14 to T15. Temperature T14 is higher than temperature T1. Also, the non-azeotropic refrigerant mixture flowing from position L13 into heat exchanger 5*b* absorbs heat from air in the process in which this non-azeotropic refrigerant mixture flows from position L13 to position L14. As a result, the temperature of the non-azeotropic refrigerant mixture rises from T15 to T2.

On the other hand, the air blown by outdoor fan 7 to heat exchanger 5*a* is deprived of heat due to absorption by the non-azeotropic refrigerant mixture flowing through heat exchanger 5*a* in the process in which the air flows from position L11 to position L12. As a result, the temperature of the air lowers from T3 to T16. The air blown by outdoor fan 7 to heat exchanger 5*b* is deprived of heat due to absorption by the non-azeotropic refrigerant mixture flowing through heat exchanger 5*b* in the process in which the air flows from position L13 to position L14. As a result, the temperature of the air lowers from T3 to T17.

Referring to FIG. 1 together with FIG. 7, in refrigeration cycle apparatus 100, heat exchangers 5*a* and 5*b* are disposed to extend in the direction orthogonal to air blowing direction Ad1. Thus, air blown to heat exchangers 5*a* and 5*b* has approximately the same temperature T3. The non-azeotropic refrigerant mixture flowing from position L13 into heat exchanger 5*b* can start exchanging of heat with air of the temperature that is approximately the same as temperature T3 of the air at position L11. As a result, the heat exchange efficiency of heat exchanger 5*b* can be improved as compared with the case where the non-azeotropic refrigerant mixture flowing into heat exchanger 5*b* continues exchanging of heat with the air having temperature T16 at position L12.

Figure 8:
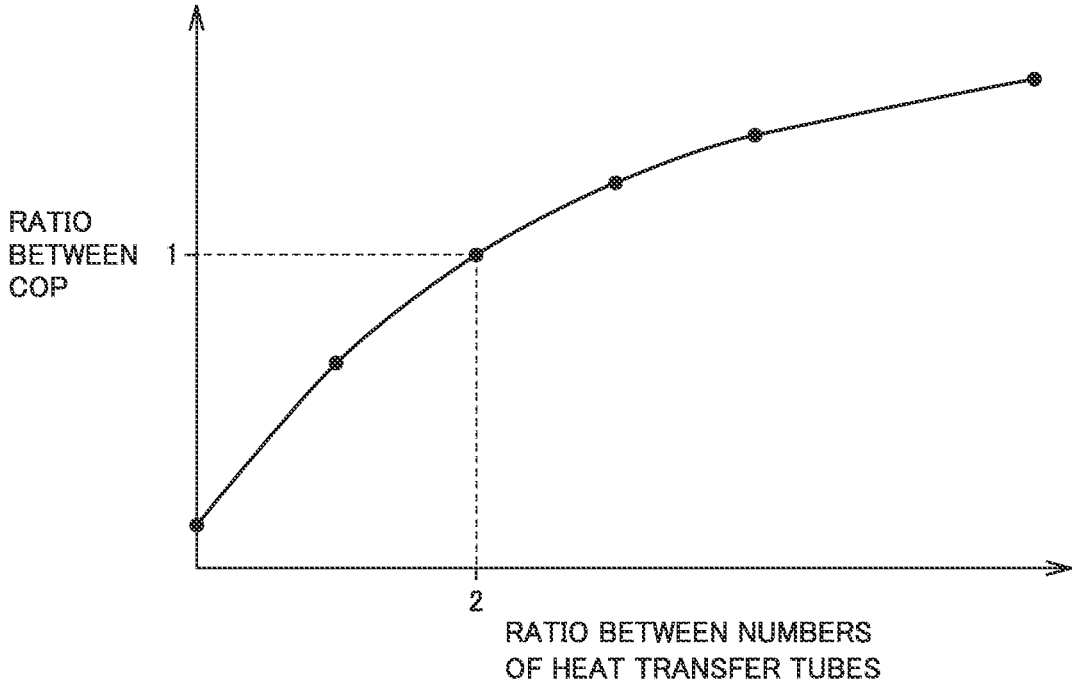
FIG. 8 is a diagram showing the correspondence relation between: a ratio between the numbers of the heat transfer tubes in two heat exchangers in FIG. 1; and a ratio of a coefficient of performance (COP) of the refrigeration cycle apparatus in FIG. 1 to a COP of the refrigeration cycle apparatus in FIG. 3.

FIG. 8 is a diagram showing the correspondence relation between: a ratio of the number of heat transfer tubes in heat exchanger 5*b* to the number of heat transfer tubes in heat exchanger 5*a* in FIG. 1; and a ratio of a coefficient of performance (COP) of refrigeration cycle apparatus 100 in FIG. 1 to a COP of refrigeration cycle apparatus 900 in FIG. 3. As shown in FIG. 8, when the ratio of the number of heat transfer tubes in heat exchanger 5*b* to the number of heat transfer tubes in heat exchanger 5*a* is 2 or more, the ratio of the coefficient of performance (COP) of refrigeration cycle apparatus 100 in FIG. 1 to the COP of refrigeration cycle apparatus 900 is 1 or more. Thus, it is desirable that the number of heat transfer tubes in heat exchanger 5*b* is equal to or greater than two times as large as the number of heat transfer tubes in heat exchanger 5*a*.

First Modification of First Embodiment

Figure 9:
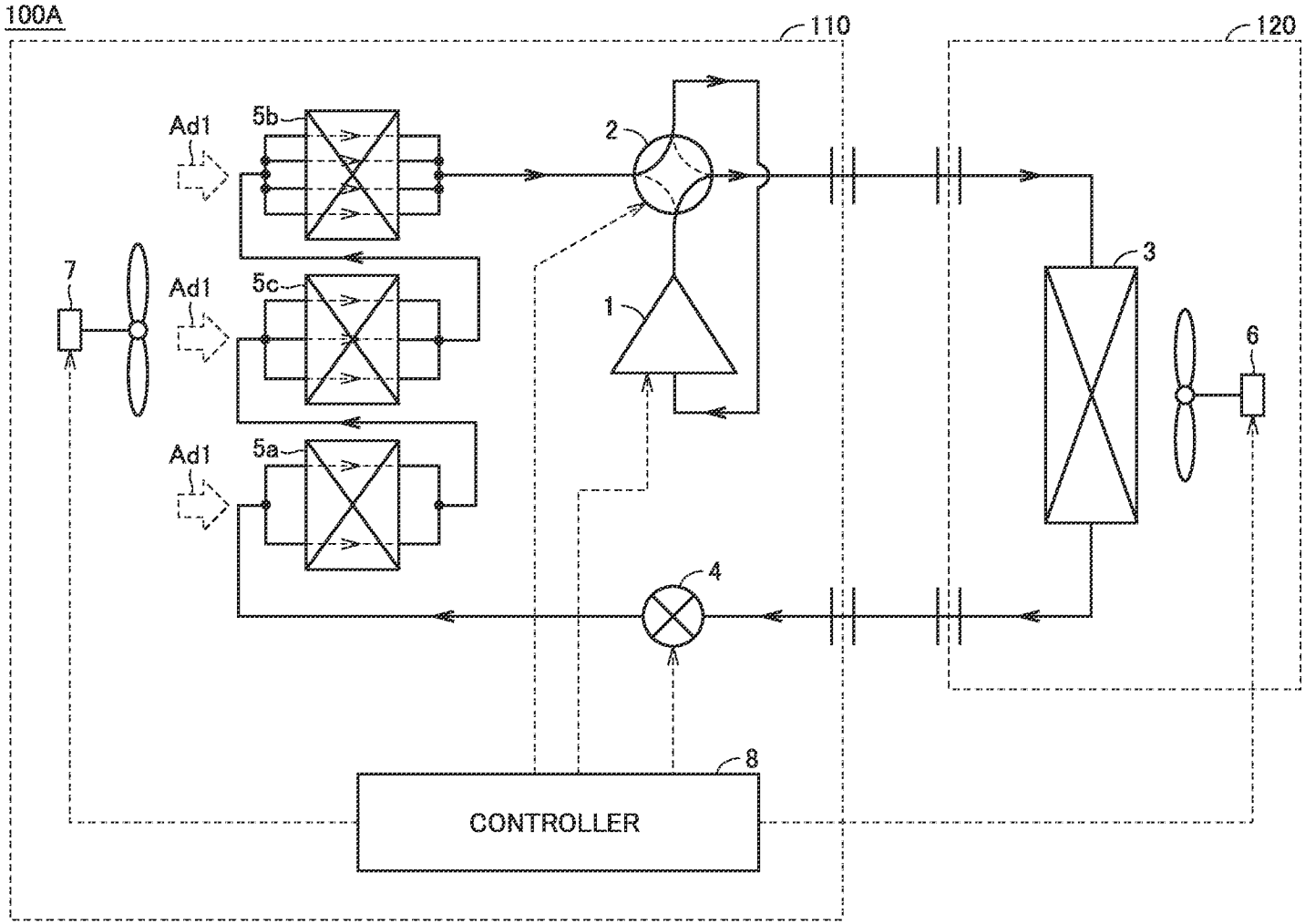
FIG. 9 is a functional block diagram showing a configuration of a refrigeration cycle apparatus according to the first modification of the first embodiment.

The first embodiment has been described with regard to the case where two heat exchangers each functioning as an evaporator are connected in series. The number of heat exchangers each functioning as an evaporator and connected in series may be three or more. FIG. 9 is a functional block diagram showing a configuration of a refrigeration cycle apparatus 100A according to the first modification of the first embodiment. Refrigeration cycle apparatus 100A has the same configuration as that of refrigeration cycle apparatus 100 in FIG. 1 except that it additionally includes a heat exchanger 5*c*. Since the configuration other than the above is the same, the description thereof will not be repeated.

As shown in FIG. 9, heat exchanger 5*c* is connected between heat exchangers 5*a* and 5*b*. Heat exchanger 5*c* is smaller in flow path resistance than heat exchanger 5*a*, and greater in flow path resistance than heat exchanger 5*b*. Heat exchanger 5*c* includes a plurality of heat transfer tubes formed so as to extend in parallel with each other. The number of heat transfer tubes in heat exchanger 5*c* is greater than the number of heat transfer tubes in heat exchanger 5*a* and less than the number of heat transfer tubes in heat exchanger 5*b*. Heat exchangers 5*a* to 5*c* are disposed to extend in the direction orthogonal to air blowing direction Ad1.

Second Modification of First Embodiment

Figure 10:
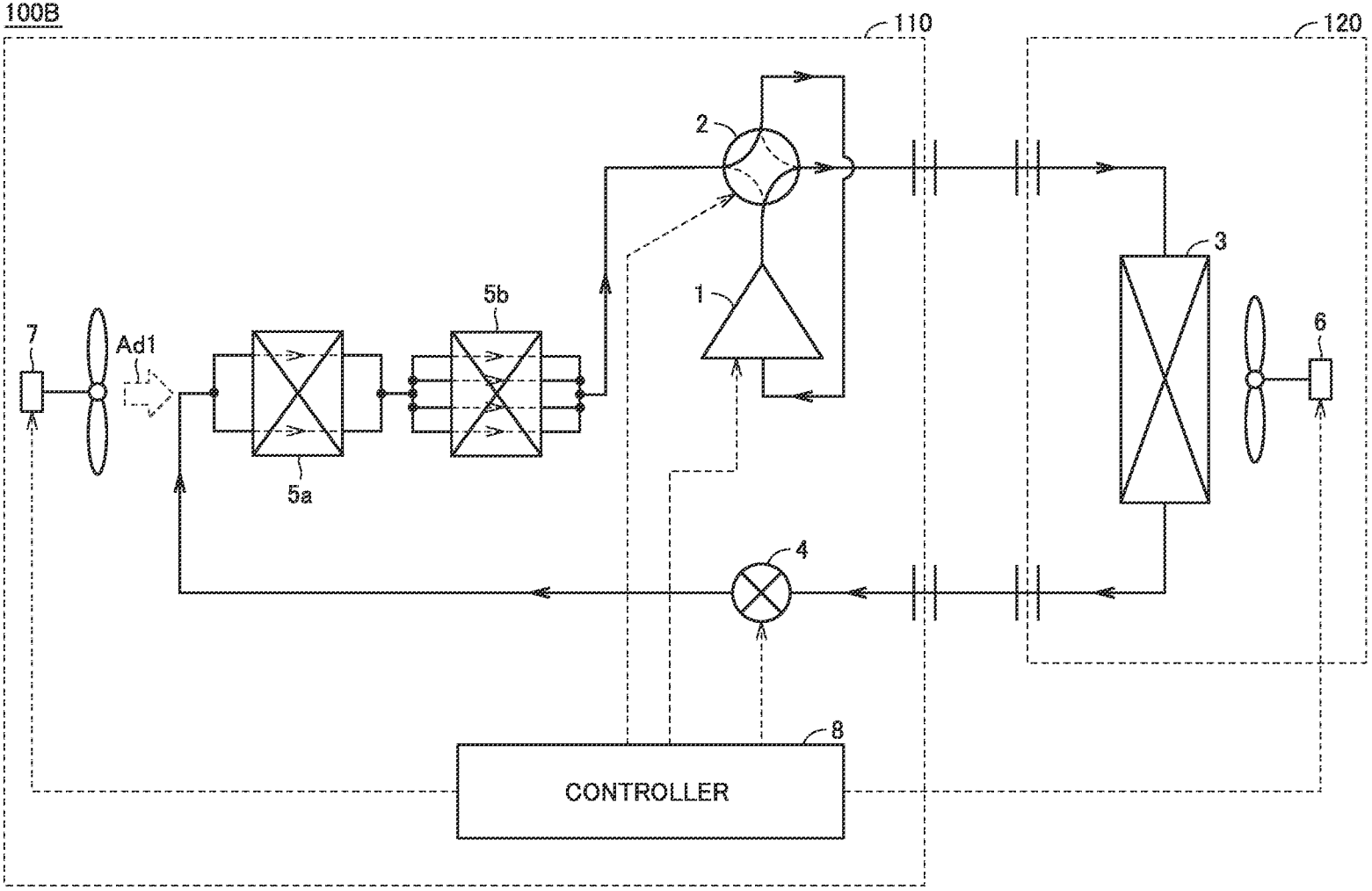
FIG. 10 is a functional block diagram showing a configuration of a refrigeration cycle apparatus according to the second modification of the first embodiment.

The first embodiment has been described with regard to the case where two heat exchangers each functioning as an evaporator are disposed to extend in the direction orthogonal to the air blowing direction of the blower. Two heat exchangers each functioning as an evaporator may be disposed to extend in the air blowing direction of the blower. FIG. 10 is a functional block diagram showing a configuration of a refrigeration cycle apparatus 100B according to the second modification of the first embodiment. Refrigeration cycle apparatus 100B has the same configuration as that of refrigeration cycle apparatus 100 in FIG. 1 except that heat exchangers 5*a* and 5*b* are disposed to extend in air blowing direction Ad1. Since the configuration other than the above is the same, the description thereof will not be repeated.

Third Modification of First Embodiment

Figure 11:
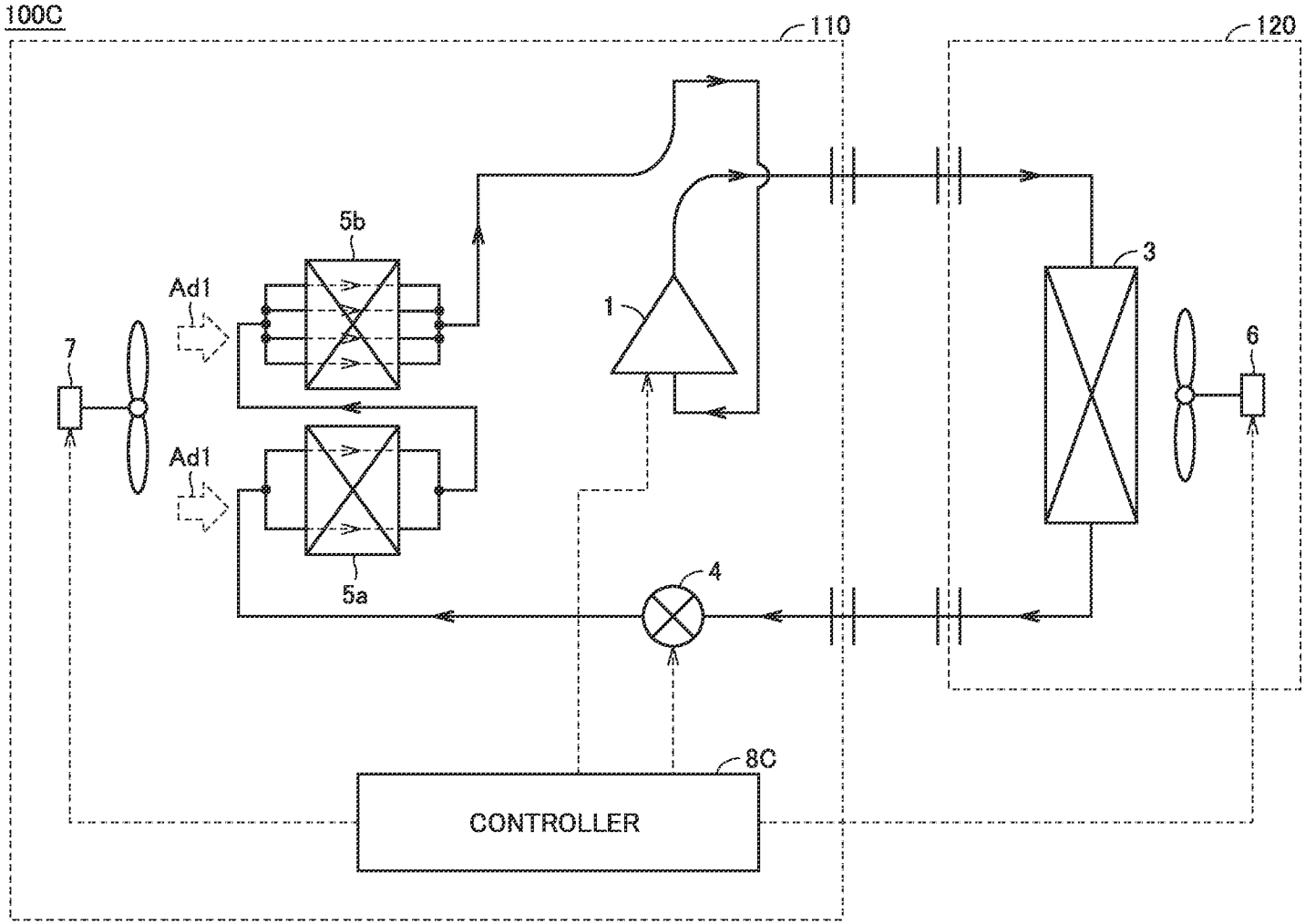
FIG. 11 is a functional block diagram showing a configuration of a refrigeration cycle apparatus according to the third modification of the first embodiment.

The first embodiment has been described with regard to the configuration including a flow path switching valve. The refrigeration cycle apparatus according to the present embodiment may also have a configuration not including a flow path switching valve, like a showcase or a refrigerator. FIG. 11 is a functional block diagram showing a configuration of a refrigeration cycle apparatus 100C according to the third modification of the first embodiment. Refrigeration cycle apparatus 100C has the same configuration as that of refrigeration cycle apparatus 100 in FIG. 1 except that four-way valve 2 is removed and controller 8 is replaced with a controller 8C. Since the configuration other than the above is the same, the description thereof will not be repeated.

In the defrosting operation, controller 8C stops compressor 1 and thereafter causes a heater (not shown) to heat the heat exchangers 5*a* and 5*b*. After the defrosting completion time has passed since the start of the heater, controller 8C stops the heater and restarts compressor 1.

The first embodiment has been described with regard to the refrigeration cycle apparatus including one outdoor unit and one indoor unit. However, the refrigeration cycle apparatus according to the present embodiment may include a plurality of outdoor units and may include a plurality of indoor units.

As described above, the refrigeration cycle apparatus according to each of the first embodiment and the first to third modifications can suppress the performance deterioration caused by frost formed on heat exchangers.

Second Embodiment

The second embodiment will be described with regard to the configuration in which air exchanging heat with two heat exchangers each functioning as an evaporator is heated by another heat exchanger so as to further suppress formation of frost as compared with the first embodiment.

Figure 12:
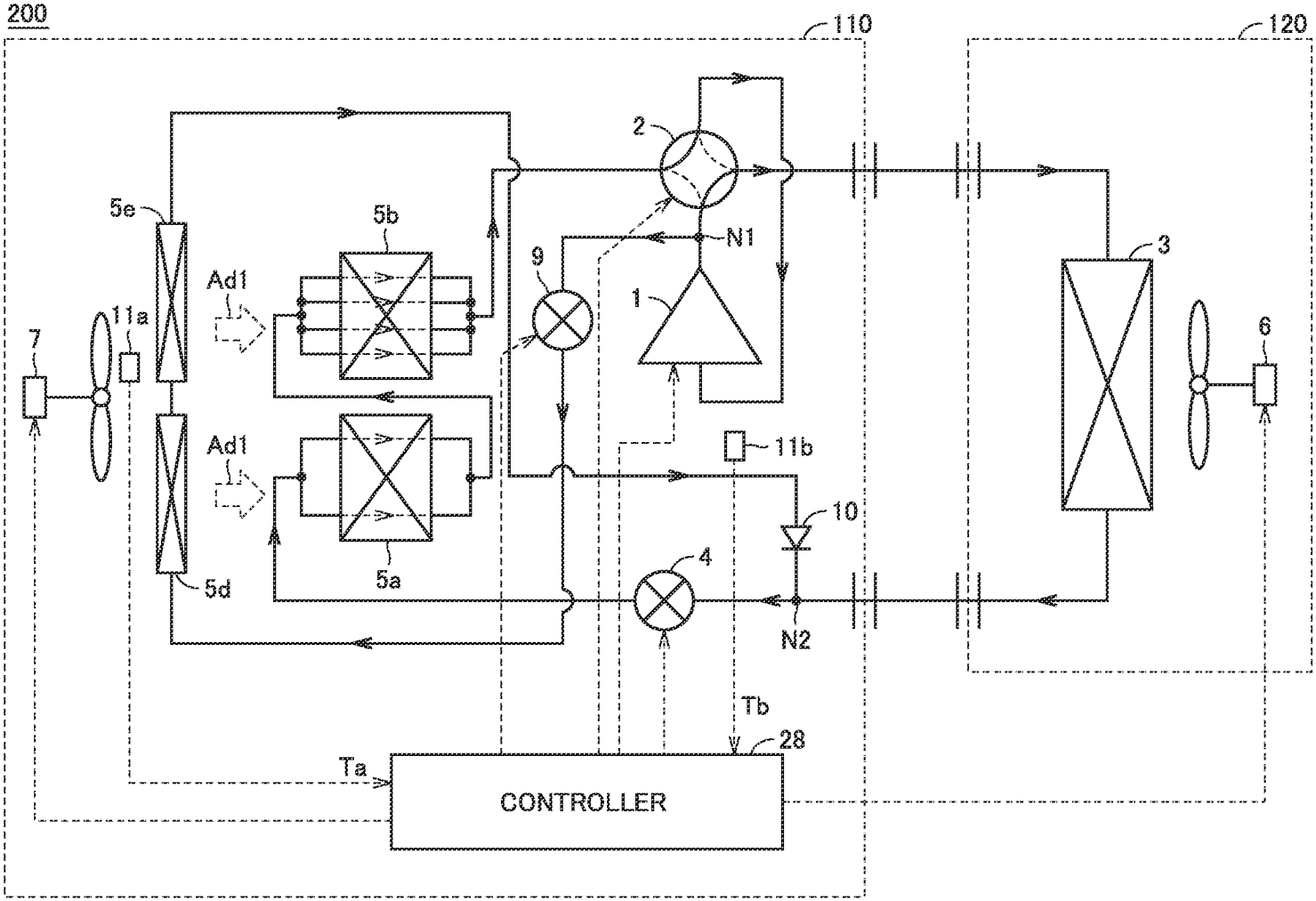
FIG. 12 is a functional block diagram showing a configuration of a refrigeration cycle apparatus according to the second embodiment together with the flow of a non-azeotropic refrigerant mixture in a heating operation.

FIG. 12 is a functional block diagram showing a configuration of a refrigeration cycle apparatus 200 according to the second embodiment together with the flow of the non-azeotropic refrigerant mixture in the heating operation. Refrigeration cycle apparatus 200 has the same configuration as that of refrigeration cycle apparatus 100 in FIG. 1 except that it additionally includes a heat exchanger 5*d* (a fourth heat exchanger), a heat exchanger 5*e* (a fifth heat exchanger), a flow rate regulating valve 9 (an on-off valve), a check valve 10, and temperature sensors 11*a* and 11*b*, and that controller 8 is replaced with a controller 28. Since the configuration other than the above is the same, the description thereof will not be repeated.

As shown in FIG. 12, flow rate regulating valve 9 is connected to a connection node N1 between the discharge port of compressor 1 and four-way valve 2. Check valve 10 is connected to a connection node N2 between expansion valve 4 and heat exchanger 3. The forward direction of check valve 10 corresponds to the direction from check valve 10 to connection node N2. Heat exchangers 5*d* and 5*e* are connected in this order in series between flow rate regulating valve 9 and check valve 10. Heat exchangers 5*d* and 5*a* are disposed in this order to extend adjacent to each other in air blowing direction Ad1. Heat exchangers 5*e* and 5*b* are disposed in this order to extend adjacent to each other in air blowing direction Ad1.

In addition, heat exchangers 5*a*, 5*b*, 5*d*, and 5*e* may be different in structure (for example, the pitch in the column direction, the pitch in the row direction, or the pitch of fins) from one another. Furthermore, it is preferable that the pitch in the row direction in each of heat exchangers 5*d* and 5*e* is set to be longer than the pitch in the row direction in each of heat exchangers 5*a* and 5*b*, thereby setting the heating distance in each of heat exchangers 5*d* and 5*e* to be longer than the heating distance in each of heat exchangers 5*a* and 5*b*. It is preferable that the pitch of the fins in each of heat exchangers 5*d* and 5*e* is set to be larger than the pitch of the fins in each of heat exchangers 5*a* and 5*b*, thereby setting the ventilation resistance in each of heat exchangers 5*d* and 5*e* to be lower than the ventilation resistance in each of heat exchangers 5*a* and 5*b*. It is preferable that the volume of heat exchanger 5*a* is equal to or less than 20% of the total volume of heat exchangers 5*a* and 5*b*.

Controller 28 opens flow rate regulating valve 9 in the heating operation. In the heating operation, part of the non-azeotropic refrigerant mixture discharged from compressor 1 passes through heat exchangers 5*d* and 5*e*. Heat exchangers 5*d* and 5*e* each function as a condenser. The air blown by outdoor fan 7 is heated by the condensation heat from the non-azeotropic refrigerant mixture that passes through heat exchanger 5*d*. This air exchanges heat with the non-azeotropic refrigerant mixture that passes through heat exchanger 5*a*. The air blown by outdoor fan 7 is heated by the condensation heat from the non-azeotropic refrigerant mixture that passes through heat exchanger 5*e*. This air exchanges heat with the non-azeotropic refrigerant mixture that passes through heat exchanger 5*b*.

From a temperature sensor 11*a*, controller 28 obtains a temperature Ta of the non-azeotropic refrigerant mixture that flows into heat exchanger 5*e*. From a temperature sensor 11*b*, controller 28 obtains a temperature Tb of the non-azeotropic refrigerant mixture that flows out of heat exchanger 5*e*. Controller 28 adjusts the degree of opening of flow rate regulating valve 9 such that the difference between temperatures Ta and Tb fall within a prescribed range. By the control as described above, the state of the non-azeotropic refrigerant mixture that passes through check valve 10 turns into a supercooled state, like the non-azeotropic refrigerant mixture that flows out of heat exchanger 3. The temperature of the non-azeotropic refrigerant mixture that flows out of heat exchanger 3 may be used in place of temperature Tb.

In refrigeration cycle apparatus 200, the air exchanging heat with heat exchanger 5*a* is heated by heat exchanger 5*d* while the air exchanging heat with heat exchanger 5*b* is heated by heat exchanger 5*e*. Thus, even when the temperature of the non-azeotropic refrigerant mixture flowing into heat exchanger 5*a* is raised, the temperature difference between air and the non-azeotropic refrigerant mixture in heat exchangers 5*a* and 5*b* can be maintained at approximately the same temperature difference between air and the non-azeotropic refrigerant mixture in heat exchangers 5*a* and 5*b* in refrigeration cycle apparatus 100 in FIG. 1. As a result, formation of frost on heat exchangers 5*a* and 5*b* can be further suppressed.

Figure 13:
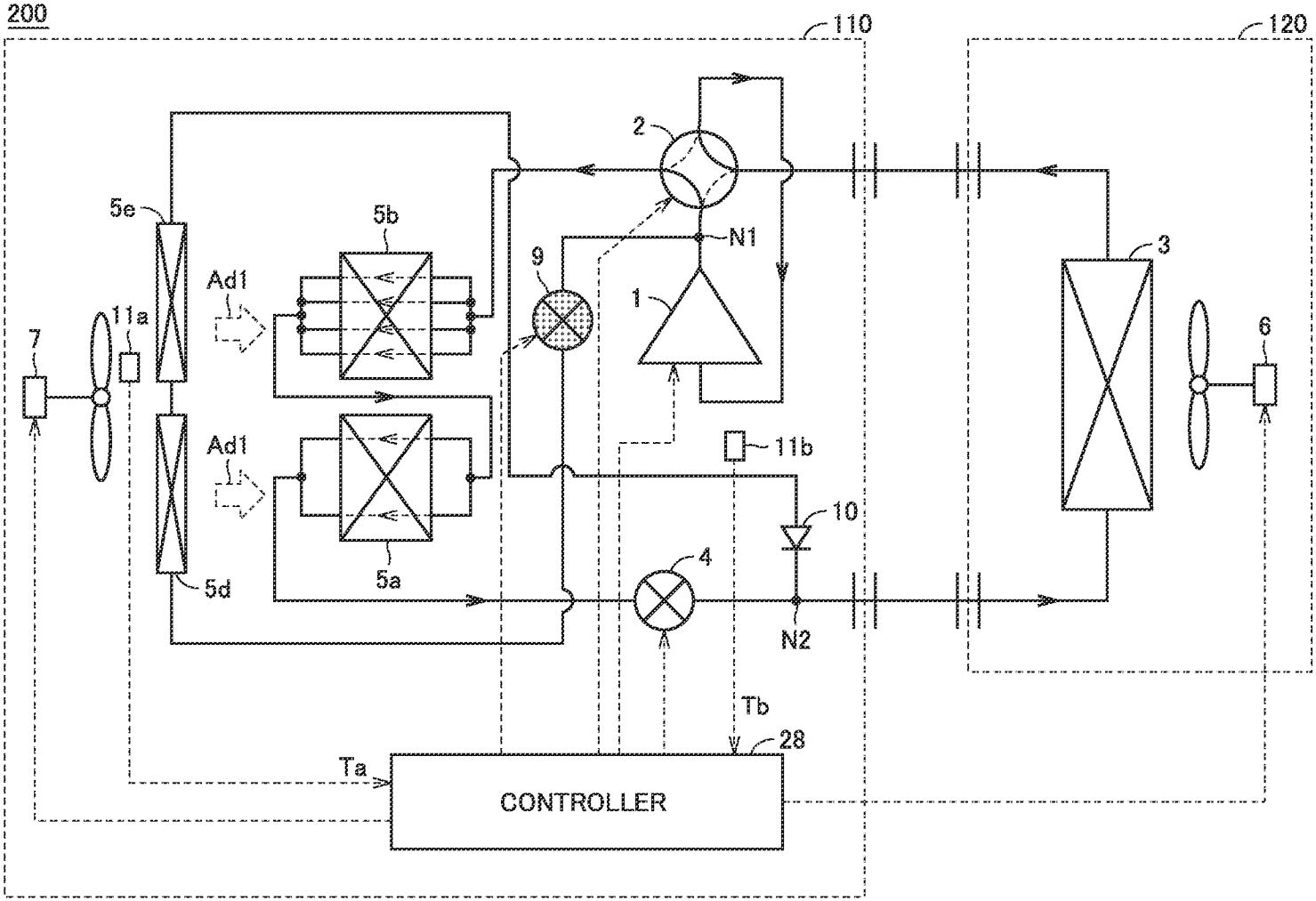
FIG. 13 is a functional block diagram showing the configuration of the refrigeration cycle apparatus according to the second embodiment together with the flow of the non-azeotropic refrigerant mixture in a cooling operation and a defrosting operation.

FIG. 13 is a functional block diagram showing the configuration of refrigeration cycle apparatus 200 according to the second embodiment together with the flow of the non-azeotropic refrigerant mixture in the cooling operation and the defrosting operation. As shown in FIG. 13, controller 28 closes flow rate regulating valve 9 in the cooling operation and the defrosting operation. In the cooling operation and the defrosting operation, the pressure of the non-azeotropic refrigerant mixture in the flow path between flow rate regulating valve 9 and check valve 10 is approximately the same as the pressure of the non-azeotropic refrigerant mixture decompressed by expansion valve 4. As the pressure decreases, the non-azeotropic refrigerant mixture evaporates, thereby increasing the ratio of the non-azeotropic refrigerant mixture in a gaseous state in the flow path between flow rate regulating valve 9 and check valve 10. Then, the non-azeotropic refrigerant mixture in a liquid state accumulated in heat exchangers 5*c* and 5*d* decreases. As a result, reduction of the amount of the non-azeotropic refrigerant mixture circulating through refrigeration cycle apparatus 200 can be suppressed.

Modification of Second Embodiment

Figure 14:
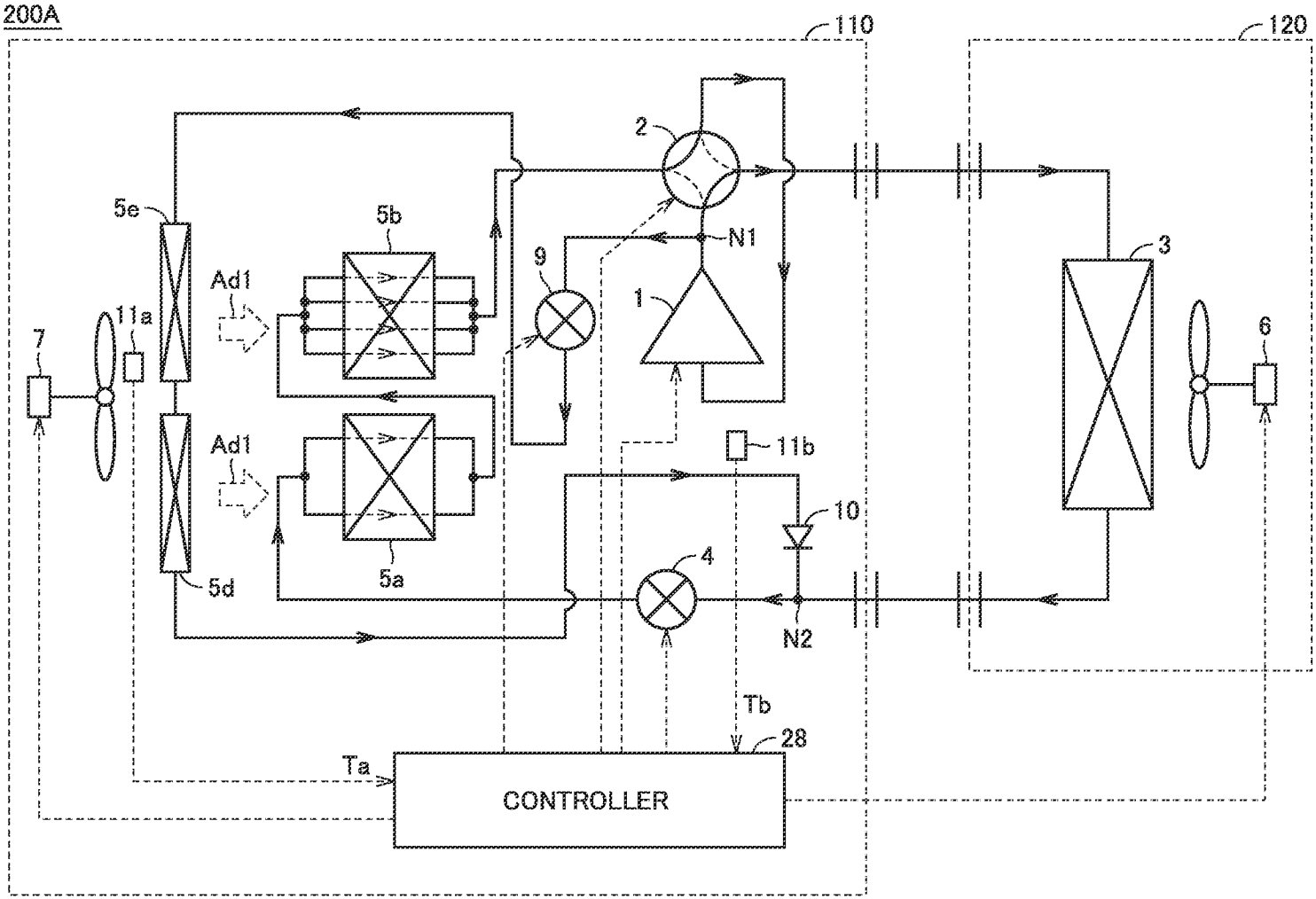
FIG. 14 is a functional block diagram showing a configuration of a refrigeration cycle apparatus according to a modification of the second embodiment together with the flow of a non-azeotropic refrigerant mixture in a heating operation.

Referring to FIG. 12, an explanation has been given with regard to the case where the non-azeotropic refrigerant mixture discharged from compressor 1 passes through heat exchangers 5*d* and 5*e* in this order. For raising the temperature of the non-azeotropic refrigerant mixture that flows into heat exchanger 5*a* into which the non-azeotropic refrigerant mixture flows, it is preferable to cause the non-azeotropic refrigerant mixture to pass through heat exchangers 5*d* and 5*e* in this order so as to set the temperature of the non-azeotropic refrigerant mixture flowing into heat exchanger 5*d* adjacent to heat exchanger 5*a* to be higher than the temperature of the non-azeotropic refrigerant mixture flowing into heat exchanger 5*e* adjacent to heat exchanger 5*b*. However, when it is difficult to form a flow path so as to cause the non-azeotropic refrigerant mixture to pass through heat exchangers 5*d* and 5*e* in this order, a flow path may be formed so as to cause the non-azeotropic refrigerant mixture to pass through heat exchangers 5*e* and 5*d* in this order, as in refrigeration cycle apparatus 200A shown in FIG. 14.

As described above, according to the refrigeration cycle apparatus in each of the second embodiment and the modification thereof, the performance deterioration caused by frost formed on the heat exchangers can be further suppressed as compared with the refrigeration cycle apparatus according to the first embodiment.

The embodiments and the modifications thereof disclosed herein are also intended to be implemented in combination as appropriate within a consistent scope. It should be understood that the embodiments and the modifications disclosed herein are illustrative and non-restrictive in every respect. The scope of the present invention is defined by the terms of the claims, rather than the description above, and is intended to include any modifications within the meaning and scope equivalent to the terms of the claims.

REFERENCE SIGNS LIST

1 compressor, 2 four-way valve, 3, 5, 5*a* to 5*e* heat exchanger, 4 expansion valve, 6 indoor fan, 7 outdoor fan, 8, 8C, 28 controller, 9 flow rate regulating valve, 10 check valve, 11*a*, 11*b* temperature sensor, 100, 100A to 100C, 200, 200A, 900 refrigeration cycle apparatus, 110 outdoor unit, 120 indoor unit.

The invention claimed is:

1. A refrigeration cycle apparatus in which a non-azeotropic refrigerant mixture is used, the refrigeration cycle apparatus comprising:

a compressor;

a first heat exchanger;

a decompressor;

a second heat exchanger;

a third heat exchanger; and a blower configured to blow air to the second heat exchanger and the third heat exchanger, wherein the non-azeotropic refrigerant mixture circulates in a first circulation direction through the compressor, the first heat exchanger, the decompressor, the second heat exchanger, and the third heat exchanger, the second heat exchanger is greater in flow path resistance than the third heat exchanger, the blower is configured to form a parallel flow with the non-azeotropic refrigerant mixture flowing through the second heat exchanger and the third heat exchanger, and a difference between enthalpy of the non-azeotropic refrigerant mixture flowing into the second heat exchanger and enthalpy of the non-azeotropic refrigerant mixture flowing out of the second heat exchanger is greater than a difference between enthalpy of the non-azeotropic refrigerant mixture flowing into the third heat exchanger and enthalpy of the non-azeotropic refrigerant mixture flowing out of the third heat exchanger.

2. The refrigeration cycle apparatus according to claim 1, wherein the non-azeotropic refrigerant mixture includes HFC32, and a weight ratio of the HFC32 is equal to or less than 46 wt %.

3. The refrigeration cycle apparatus according to claim 1, wherein the second heat exchanger has at least one heat transfer tube through which the non-azeotropic refrigerant mixture flows, the third heat exchanger has a plurality of heat transfer tubes that are formed to extend in parallel with each other, the non-azeotropic refrigerant mixture flowing through the plurality of heat transfer tubes, and the second heat exchanger is less in number of heat transfer tubes than the third heat exchanger.

4. The refrigeration cycle apparatus according to claim 3, wherein the number of heat transfer tubes in the third heat exchanger is equal to or greater than two times as large as the number of heat transfer tubes in the second heat exchanger.

5. The refrigeration cycle apparatus according to claim 1, further comprising a flow path switching valve configured to switch a circulation direction of the non-azeotropic refrigerant mixture between the first circulation direction and a second circulation direction opposite to the first circulation direction, wherein when the circulation direction of the non-azeotropic refrigerant mixture corresponds to the second circulation direction, the blower forms a counterflow with respect to the non-azeotropic refrigerant mixture that flows through the second heat exchanger and the third heat exchanger.

6. The refrigeration cycle apparatus according to claim 5, wherein the second heat exchanger and the third heat exchanger are disposed to extend in a direction orthogonal to an air blowing direction of the blower.

7. The refrigeration cycle apparatus according to claim 5, further comprising a fourth heat exchanger connected between the second heat exchanger and the third heat exchanger, wherein the fourth heat exchanger is smaller in flow path resistance than the second heat exchanger and is greater in flow path resistance than the third heat exchanger, the blower is configured to form a parallel flow with the non-azeotropic refrigerant mixture flowing through the second heat exchanger, the third heat exchanger, and the fourth heat exchanger, and the second heat exchanger, the third heat exchanger, and the fourth heat exchanger are disposed to extend in a direction orthogonal to an air blowing direction of the blower.

8. The refrigeration cycle apparatus according to claim 6, further comprising:

an on-off valve connected to a discharge port of the compressor;

a check valve connected to a connection node between the first heat exchanger and the decompressor;

a fourth heat exchanger and a fifth heat exchanger; and a controller, wherein the fourth heat exchanger and the fifth heat exchanger are connected in series between the on-off valve and the check valve in order of the fourth heat exchanger and the fifth heat exchanger, the fourth heat exchanger and the second heat exchanger are disposed in order of the fourth heat exchanger and the second heat exchanger to extend in the air blowing direction, the fifth heat exchanger and the third heat exchanger are disposed in order of the fifth heat exchanger and the third heat exchanger to extend in the air blowing direction, a forward direction of the check valve corresponds to a direction from the check valve to the connection node, and the controller is configured to open the on-off valve when the circulation direction of the non-azeotropic refrigerant mixture corresponds to the first circulation direction, and close the on-off valve when the circulation direction of the non-azeotropic refrigerant mixture corresponds to the second circulation direction.

* * * * *